US010370916B2

(12) United States Patent
O'Brien et al.

(10) Patent No.: US 10,370,916 B2
(45) Date of Patent: Aug. 6, 2019

(54) APPARATUS AND METHODS FOR LOCATING A PARTICULAR LOCATION IN A WELLBORE FOR PERFORMING A WELLBORE OPERATION

(71) Applicants: Robert S. O'Brien, Katy, TX (US); Jason A. Allen, Houston, TX (US); Andrew James Cayson, Cypress, TX (US); Geoffrey York Powers, Houston, TX (US)

(72) Inventors: Robert S. O'Brien, Katy, TX (US); Jason A. Allen, Houston, TX (US); Andrew James Cayson, Cypress, TX (US); Geoffrey York Powers, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 900 days.

(21) Appl. No.: 14/487,973

(22) Filed: Sep. 16, 2014

(65) Prior Publication Data

US 2015/0075788 A1 Mar. 19, 2015

Related U.S. Application Data

(60) Provisional application No. 61/878,357, filed on Sep. 16, 2013.

(51) Int. Cl.
*E21B 23/02* (2006.01)
*E21B 23/06* (2006.01)

(52) U.S. Cl.
CPC ..... *E21B 23/02* (2013.01); *E21B 23/06* (2013.01)

(58) Field of Classification Search
CPC ..... E21B 23/00; E21B 23/02
See application file for complete search history.

(56) References Cited

U.S. PATENT DOCUMENTS 80,875 A 8/1868 Platt et al.
85,428 A 12/1868 Burditt et al.
(Continued)

FOREIGN PATENT DOCUMENTS

EP 1001132 A2 5/2000
WO 0026501 A1 5/2000
(Continued)

OTHER PUBLICATIONS

PCT International Search Report and Written Opinion, International Application No. PCT/US2014/055887; International Filing Date: Sep. 16, 2014; dated Dec. 18, 2014; pp. 1-10.
(Continued)

*Primary Examiner* — Robert E Fuller
(74) *Attorney, Agent, or Firm* — Cantor Colburn LLP

(57) ABSTRACT

An apparatus for use in a wellbore. The apparatus includes a locating device having a locating collet configured to engage with a locating profile on a housing and disengage from the locating profile when a first pull load is applied to the locating collet, a delay device that prevents application of the first pull load on the locating collet when it is engaged with the locating profile until the delay device has been activated, and a locking device configured to prevent activation of the delay device until a second pull load less than the first is applied on the locking device for a selected period of time.

21 Claims, 6 Drawing Sheets

(56) References Cited

U.S. PATENT DOCUMENTS

| | | | | |
|---|---|---|---|---|
| 1,342,813 | A | 6/1920 | Huston | |
| 3,025,914 | A | 3/1962 | Fether | |
| 3,133,595 | A | 5/1964 | Loughney et al. | |
| 3,356,145 | A | 12/1967 | Fredd | |
| 3,504,936 | A | 4/1970 | Brown et al. | |
| 3,677,346 | A | 7/1972 | Tamplen | |
| 3,726,546 | A | 4/1973 | Brown | |
| 3,856,081 | A | 12/1974 | Canalizo | |
| 4,125,129 | A | 11/1978 | Baumann | |
| 4,176,717 | A | 12/1979 | Hix | |
| 4,267,045 | A | 5/1981 | Hoof | |
| 4,281,858 | A | 8/1981 | Bower | |
| 4,369,840 | A | 1/1983 | Szarka et al. | |
| 4,423,889 | A | 1/1984 | Weise | |
| 4,778,008 | A | 10/1988 | Gonzalez et al. | |
| 4,840,229 | A | 6/1989 | Proctor et al. | |
| 5,044,433 | A | 9/1991 | Rubbo et al. | |
| 5,092,402 | A * | 3/1992 | Perricone | E21B 47/09 166/113 |
| 5,122,271 | A | 6/1992 | Simon et al. | |
| 5,341,880 | A | 8/1994 | Thorstensen | |
| 5,513,703 | A | 5/1996 | Mills et al. | |
| 5,769,122 | A | 6/1998 | Baumann et al. | |
| 5,823,264 | A | 10/1998 | Ringgenberg | |
| 6,003,607 | A | 12/1999 | Hagen et al. | |
| 6,367,552 | B1 | 4/2002 | Scott et al. | |
| 6,382,319 | B1 * | 5/2002 | Hill, Jr. | E21B 43/045 166/194 |
| 6,447,021 | B1 | 9/2002 | Haynes | |
| 6,978,840 | B2 | 12/2005 | Henderson | |
| 7,055,598 | B2 | 6/2006 | Ross et al. | |
| 7,086,479 | B2 | 8/2006 | Schultz et al. | |
| 7,284,606 | B2 | 10/2007 | Coronado | |
| 7,578,343 | B2 | 8/2009 | Augustine | |
| 7,673,678 | B2 | 3/2010 | MacDougall et al. | |
| 8,061,430 | B2 | 11/2011 | Du et al. | |
| 8,201,623 | B2 | 6/2012 | O'Brien | |
| 8,220,555 | B1 | 7/2012 | Wintill et al. | |
| 8,286,701 | B2 | 10/2012 | Schultz et al. | |
| 8,403,061 | B2 | 3/2013 | Russell et al. | |
| 8,403,064 | B2 | 3/2013 | Allen | |
| 8,424,609 | B2 | 4/2013 | Duphorne et al. | |
| 8,474,542 | B2 | 7/2013 | Blanton et al. | |
| 2002/0092653 | A1 | 7/2002 | Scott et al. | |
| 2002/0117301 | A1 | 8/2002 | Womble | |
| 2003/0029621 | A1 | 2/2003 | Haynes | |
| 2003/0141059 | A1 | 7/2003 | Mauldin et al. | |
| 2003/0188894 | A1 | 10/2003 | Sunde et al. | |
| 2005/0039916 | A1 | 2/2005 | Schultz et al. | |
| 2006/0027377 | A1 | 2/2006 | Schoonderbeek et al. | |
| 2006/0219413 | A1 | 10/2006 | Vilela et al. | |
| 2006/0260818 | A1 | 11/2006 | Meijer et al. | |
| 2007/0131434 | A1 | 6/2007 | MacDougall et al. | |
| 2009/0133874 | A1 | 5/2009 | Dale et al. | |
| 2010/0163250 | A1 | 7/2010 | Schultz et al. | |
| 2010/0224375 | A1 | 9/2010 | Du et al. | |
| 2010/0252250 | A1 | 10/2010 | Fripp et al. | |
| 2011/0048706 | A1 | 3/2011 | Clem et al. | |
| 2011/0079396 | A1 | 4/2011 | Russell et al. | |
| 2011/0127047 | A1 | 6/2011 | Themig et al. | |
| 2011/0146988 | A1 | 6/2011 | McGlothen | |
| 2011/0186286 | A1 | 8/2011 | Allen | |
| 2011/0209873 | A1 | 9/2011 | Stout | |
| 2011/0226481 | A1 | 9/2011 | Duphorne et al. | |
| 2011/0278017 | A1 | 11/2011 | Themig et al. | |
| 2012/0085544 | A1 | 4/2012 | Shilling et al. | |
| 2012/0085548 | A1 | 4/2012 | Fleckenstein et al. | |
| 2013/0048305 | A1 | 2/2013 | Xu et al. | |
| 2013/0108356 | A1 | 5/2013 | Stautzenberger et al. | |
| 2013/0112410 | A1 | 5/2013 | Szarka et al. | |
| 2013/0199799 | A1 | 8/2013 | Phan et al. | |
| 2014/0144619 | A1 | 3/2014 | O'Brien | |
| 2014/0116699 | A1 | 5/2014 | Helms et al. | |
| 2014/0158357 | A1 | 6/2014 | Lyashkov et al. | |
| 2014/0166312 | A1 | 6/2014 | Richards et al. | |
| 2014/0318780 | A1 | 10/2014 | Howard | |
| 2015/0075815 | A1 | 3/2015 | O'Brien et al. | |
| 2015/0129239 | A1 | 5/2015 | Richard | |
| 2015/0252628 | A1 | 9/2015 | Cochran et al. | |
| 2015/0375144 | A1 | 12/2015 | Greci | |
| 2016/0069145 | A1 | 3/2016 | McGuire et al. | |
| 2016/0076337 | A1 | 3/2016 | Harper et al. | |
| 2016/0084018 | A1 | 3/2016 | Allen | |
| 2016/0123093 | A1 | 5/2016 | Richards et al. | |
| 2016/0153248 | A1 | 6/2016 | Richards et al. | |
| 2017/0183919 | A1 | 6/2017 | Cochran et al. | |

FOREIGN PATENT DOCUMENTS

| | | | |
|---|---|---|---|
| WO | 2007078375 | A2 | 7/2007 |
| WO | 2012162792 | | 12/2012 |
| WO | W02012162792 | A1 | 12/2012 |

OTHER PUBLICATIONS

PCT International Search Report and Written Opinion; International Application No. PCT/US2014/055889; International Filing Date: Sep. 16, 2014; dated Dec. 23, 2014; pp. 1-10.

PCT International Search Report and Written Opinion; International Application No. PCT/US2014/055886; International Filing Date: Sep. 16, 2014; dated Dec. 19, 2014; pp. 1-9.

PCT International Search Report and Written Opinion; International Application No. PCT/US2015/014607; International Filing Date: Feb. 5, 2015; dated May 19, 2015; pp. 1-10.

PCT International Search Report and Written Opinion; International Application No. PCT/US2015/017515; International Filing Date: Feb. 25, 2015; dated Jun. 8, 2015; 16 Pages.

* cited by examiner

APPARATUS AND METHODS FOR LOCATING A PARTICULAR LOCATION IN A WELLBORE FOR PERFORMING A WELLBORE OPERATION

CROSS-REFERENCE TO RELATED APPLICATIONS

This application takes priority from U.S. Provisional application Ser. No. 61/878,357, filed on Sep. 16, 2013, which is incorporated herein in its entirety by reference.

BACKGROUND

1. Field of the Disclosure

This disclosure relates generally to apparatus and methods for completing a wellbore for the production of hydrocarbons from subsurface formations, including fracturing selected formation zones in a wellbore, sand packing and flooding a formation with a fluid.

2. Background of the Art

Wellbores are drilled in subsurface formations for the production of hydrocarbons (oil and gas). Modern wells can extend to great well depths, often more than 1500 meters. Hydrocarbons are trapped in various traps in the subsurface formations at different depths. Such sections of the formation are referred to as reservoirs or hydrocarbon-bearing formations or zones. Some formations have high mobility, which is a measure of the ease of the hydrocarbons flow from the reservoir into a well drilled through the reservoir under natural downhole pressures. Some formations have low mobility and the hydrocarbons trapped therein are unable to move with ease from the reservoir into the well. Stimulation methods are typically employed to improve the mobility of the hydrocarbons through the reservoirs. One such method, referred to as fracturing (also referred to as "fracing" or "fracking"), is often utilized to create cracks in the reservoir to enable the fluid from the formation (formation fluid) to flow from the reservoir into the wellbore. To fracture multiple zones, an assembly containing an outer string with an inner string therein is run in or deployed in the wellbore. The outer string is conveyed in the wellbore with a tubing attached to its upper end and includes various devices corresponding to each zone to be fractured for supplying a fluid with proppant to each such zone. The outer string includes certain profiles where the inner string may be engaged to perform a wellbore operation. For selectively treating a zone in a multi-zone wellbore, it is desirable to have an inner string that can be selectively set corresponding to any zone in a multi-zone well and perform a well operation at such selected zone. Once a zone has been treated, the wellbore is filled with the treatment fluid, which may include a base fluid, such as water, proppant, such as sand or synthetic sand-like particles and an additive, such as guar. A locating tool in the inner string is often used to engage with a profile in the outer string to provide a flow path from the outer string to the inner string to remove treatment fluid from the wellbore.

The disclosure herein provides apparatus and methods for engaging the inner string with the outer string at selected profiles in the outer string.

SUMMARY

In one aspect, an apparatus for use in a wellbore is disclosed that in one non-limiting embodiment includes a locating device having a locating collet configured to engage with a locating profile on a housing and disengage from the locating profile when a first pull load is applied to the locating collet, a delay device that prevents application of the first pull load on the locating collet when it is engaged with the locating profile until the delay device has been activated, and a locking device configured to prevent activation of the delay device until a second pull load less than the first is applied on the locking device for a selected period of time.

In another aspect, a method of performing an operation in a wellbore is disclosed that in one embodiment includes: conveying an outer string and an inner string into a wellbore, wherein the outer string includes a locating profile and the inner string includes a locating device having a locating collet configured to engage with a locating profile on a housing and disengage from the locating profile when a first pull load is applied to the locating collet, a delay device that prevents application of the first pull load on the locating collet when it is engaged with the locating profile until the delay device has been activated, and a locking device configured to prevent activation of the delay device until application of a second pull load on the locking device for a selected period of time, wherein the second pull load is less than the first pull load; pulling the inner string to engage the locating collet with the locating profile; and performing the wellbore operation.

Examples of the more important features of a well completion system and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally represented by same numerals and wherein.

DETAILED DESCRIPTION OF THE DRAWINGS

Figure 1:
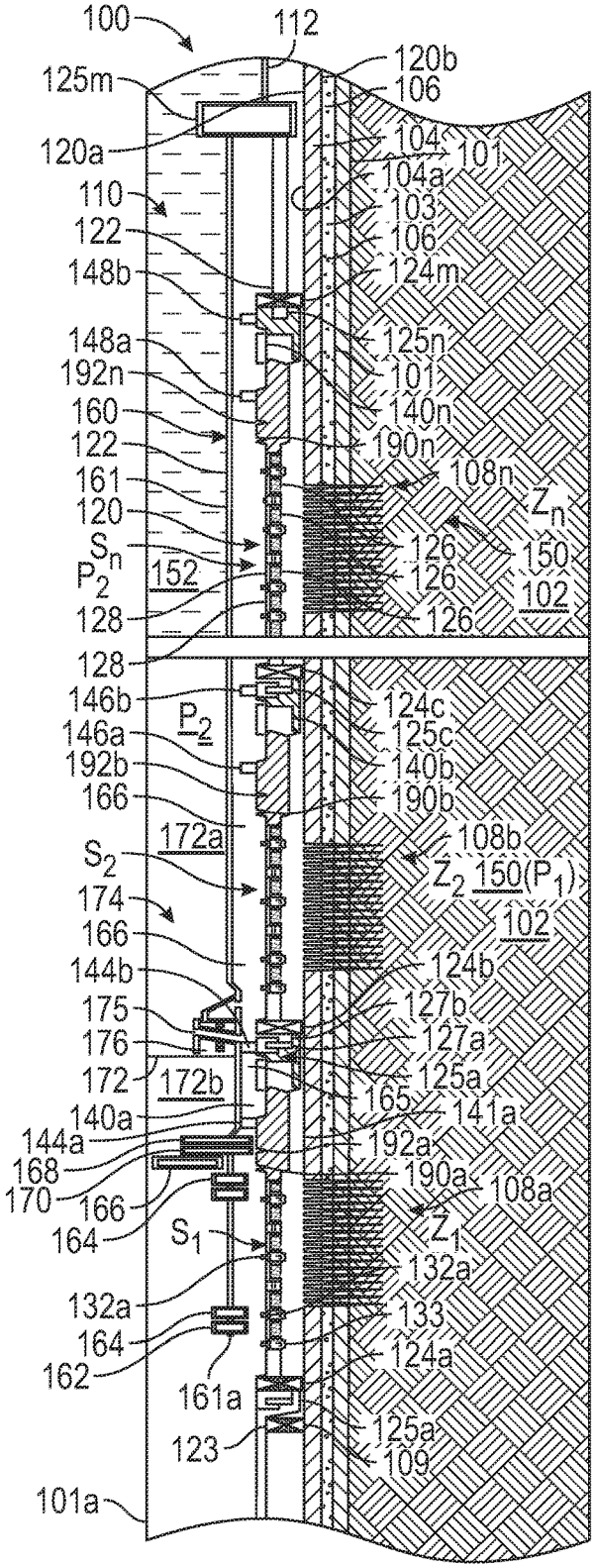
FIG. 1 shows an exemplary cased-hole multi-zone wellbore that has a service assembly deployed therein that includes an outer string and an inner string, wherein the inner string includes a locating tool made according to one non-limiting embodiment of the present disclosure.

FIG. 1 is a line diagram of a section of a wellbore system 100 that is shown to include a wellbore 101 formed in formation 102 for performing a treatment operation therein, such as fracturing the formation (also referred to herein as fracing or fracking), gravel packing, flooding, etc. The wellbore 101 is lined with a casing 104, such as a string of jointed metal pipes sections, known in the art. The space or annulus 103 between the casing 104 and the wellbore 101 is filled with cement 106. The particular embodiment of FIG. 1 is shown for selectively fracking one or more zones in any selected or desired sequence or order. However, wellbore 101 may be configured to perform other treatment or service operations, including, but not limited to, gravel packing and flooding a selected zone to move fluid in the zone toward a production well (not shown).The formation 102 is shown to include multiple zones Z1-Zn which may be fractured or treated for the production of hydrocarbons therefrom. Each such zone is shown to include perforations that extend from the casing 104, through cement 106 and to a certain depth in the formation 102. In FIG. 1, Zone Z1 is shown to include perforations 108*a,* Zone Z2 perforations 108*b,* and Zone Zn perforations 108*n.* The perforations in each zone provide fluid passages for fracturing each such zone. The perforations also provide fluid passages for formation fluid 150 to flow from the formation 102 to the inside 104*a* of the casing 104. The wellbore 101 includes a sump packer 109 proximate to the bottom 101*a* of the wellbore 101. The sump packer 109 is typically deployed after installing casing 204 and cementing the wellbore 101. The sump packer 109 is tested to a pressure rating before treating the well, such as fracturing and packing, which pressure rating may be below the expected pressures in the wellbore 101 after a zone has been treated and isolated.

After casing and cementing, the wellbore 101 is ready for treatment operations, such as fracturing and gravel packing of each of the production zones Z1-Zn. Although system 100 is described in reference to fracturing and sand packing production zones, the apparatus and methods described herein or with obvious modifications may also be utilized for other well treatment operations, including, but not limited to, gravel packing and water flooding. The formation 102 has a fluid 150 therein at formation pressure (P1) and the wellbore 101 is filled with a fluid 152, such as completion fluid, which fluid provides hydrostatic pressure (P2) inside the wellbore 101. The hydrostatic pressure P2 is greater than the formation pressure P1 along the depth of the wellbore 101, which prevents flow of the fluid 150 from the formation 102 into the casing 104 and prevents blow-outs.

Still referring to FIG. 1, to fracture (treat) one or more zones Z1-Zn, a system assembly 110 is run inside the casing 104 by a conveying member 112, which may be a tubular made of jointed pipe section, known in the art. In one non-limiting embodiment, the system assembly 110 includes an outer string 120 and an inner string 160 placed inside the outer string 120. The outer string 120 includes a pipe 122 and a number of devices associated with each of the zones Z1-Zn for performing treatment operations described in detail below. In one non-limiting embodiment, the outer string 120 includes a sealing member 123*a,* outside and proximate to a bottom end 123 of the outer string 120. The outer string 120 further includes a lower packer 124*a,* an upper packer 124*m* and intermediate packers 124*b,* 124*c,* etc. The lower packer 124*a* isolates the sump packer 109 from hydraulic pressure exerted in the outer string 120 during fracturing and sand packing of the production zones Z1-Zn. In this case the number of packers in the outer string 120 is one more than the number of zones Z1-Zn. In some cases, the lower packer 109, however, may be utilized as the lower packer 124*a.* In one non-limiting embodiment, the intermediate packers 124*b,* 124*c,* etc. may be configured to be independently deployed in any desired order so as to fracture and pack any of the zones Z1-Zn in any desired order. In another embodiment, some or all the packers may be configured to be deployed at the same time or substantially at the same time. In one aspect, packers 124*a*-124*m* may be hydraulically set or deployed packers. In another aspect, packers 124*a*-124*m* may be mechanically set or deployed.

Still referring to FIG. 1, the outer string 120 further includes a screen adjacent to each zone. For example, screen S1 is shown placed adjacent to zone Z1, screen S2 adjacent zone Z2 and screen Sn adjacent to zone Zn. The lower packer 124*a* and intermediate packer 124*b,* when deployed, will isolate zone Z1 from the remaining zones: packers 124*b* and 124*c* will isolate zone Z2 and packers 124*m*-1 and 124*m* will isolate zone Zn. In one non-limiting embodiment, each packer has an associated packer activation device, such as a valve, that allows selective deployment of its corresponding packer in any desired order. In FIG. 1, a packer activation device 125*a* is associated with the lower packer 124*a,* device 125*b* with intermediate packer 124*b,* device 125*c* with intermediate packer 124*c* and device 125*m* with the upper packer 124*m.* In one aspect, packers 124*a*-224*m* may be hydraulically-activated packers. In one aspect, the lower packer 124*a* and the upper packer 124*m* may be activated at the same or substantially the same time when a fluid under pressure is supplied to the pipe 112. In one non-limiting embodiment, the activation devices associated with the intermediate packers 124*b,* 124*c,* etc. may include a balanced piston device that remains under a balanced pressure condition (also referred to herein as the "inactive mode") to prevent a pressure differential between the inside 120*a* and outside 120*b* of the outer sting 120 to activate the packer. When a packer activation device is activated by an external mechanism, it allows pressure of the fluid in the outer string 120 to cause its associated packer to be set or deployed.

Still referring to FIG. 1, in one non-limiting embodiment, each of the screens S1-Sn may be made by serially connecting two or more screen sections with interconnecting connection members to form a screen of a desired length, wherein the interconnections provide axial fluid communication between the adjacent screen sections. For example, screen Sn is shown to include screen sections 126 interconnected by connections 128. The connections 128 may include a flow communication device, such as a sliding sleeve valve or sleeve 133, to provide flow of the fluid 150 from the formation 102 into the outer string 120. Similarly, other screens may also include several screen sections and corresponding connection devices. The connections 128 allow axial flow between the screen sections 126. The outer string 120 also includes, for each zone, a flow control device, referred to as a slurry outlet or a gravel exit, such as a sliding sleeve valve or another valve, uphole or above its corresponding screen to provide fluid communication between the inside 120*a* of the outer string 120 and each of the zones Z1-Zn. As shown in FIG. 1, a slurry outlet 140*a* is provided for zone Z1 between screen S1 and its intermediate packer 124*b,* device 140*b* for zone Z2 and device 140*n* for zone Zn. In FIG. 1, device 140*a* is shown open while devices 140*b*-140*n* are shown in the closed position so no fluid can flow from the inside 120*a* of the outer string 120 to any of the zones Z2-Zn, until opened downhole.

In yet another aspect, the outer string 120 may further include an inverted seal below and another above each inflow control device for performing a treatment operation. In FIG. 1, inverted seals 144*a* and 144*b* are shown associated with slurry outlet 140*a,* inverted seals 146*a* and 146*b* with the slurry outlet 140*b* and inverted seals 148*a* and 148*b* with slurry outlet 140*n*. In one aspect, the inverted seals 144*a*, 144*b*, 146*a*, 146*b*, 148*a* and 148*b* may be configured so that they can be pushed inside 120 of the outer string 120 or removed from the inside of the outer string 120 after completion of the treatment operations or during the deployment of a production string (not shown) for the production of hydrocarbons from wellbore 101. Pushing inverted seals inside 120*a* the outer string 120 or removing such seals from the inside 120*a* of the outer string 120 provides increased inside diameter of the outer string 120 for the installation of a production string for the production of hydrocarbons from zones Z1-Zn compared to an outer string having seals extending inside 120*a* the outer string 120. Seals 144*a*, 144*b*, 146*a*, 146*b*, 148*a* and 148*b* may, however, be placed on the outside of the inner string instead on the inside of the outer string. In one non-limiting embodiment, the outer string 120 also includes a zone indicating profile or locating profile (profile 190*a* for zone Z1, profile 190*b* for zone Z2 and profile 190*n* for zone Zn) for each zone and a corresponding set down profile (192*a* for zone Z1, 192*b* for zone Z2 and 192*n* for zone Zn).

Still referring to FIG. 1, the inner string 160 (also referred to herein as the service string) may be a metallic tubular member 161 that in one embodiment includes an opening shifting tool 162 and a closing shifting tool 164 along the lower end 161*a* of the inner string 160. The inner string 160 further may include a reversing valve 166 that enables the removal of treatment fluid from the wellbore after treating each zone, and an up-strain locating tool 168 for locating a location uphole of the set down locations Such as locations 192*a* for zone Z1, 192*b* for zone and 192*n* for Zone Zn) when the inner string 160 is pulled uphole. A set down tool 170 may then bet set down in a set down location 192*a*, 192*b* and 192*n* in the outer string 120 for performing a treatment operation. The inner string 160 further includes a plug 172 above the set down locating tool 170, which prevents fluid communication between the space 172*a* above the plug 172 and the space 172*b* below the plug 172. The inner string 160 further includes a crossover tool 174 (also referred to herein as the "frac port") for providing a fluid path 175 between the inner string 160 and the outer string 120. In one aspect, the frac port 174 also includes flow passages 176 therethrough, which passages may be gun-drilled through the frac port 174 to provide fluid communication between space 172*a* and 172*b*. In one embodiment, the passages 176 are sufficiently narrow so that that there is relatively small amount of fluid flow through such passages. The passages 176, however, are sufficient to provide fluid flow and thus pressure communication between spaces 172*a* and 172*b*.

To perform a treatment operation in a particular zone, for example zone Z1, lower packer 124*a* and upper packer 124*m* are set or deployed. Setting the upper 124*m* and lower packer 124*a* anchors the outer string 120 inside the casing 104. The production zone Z1 is then isolated from all the other zones. To isolate zone Z1 from the remaining zones Z2-Zn, the inner string 160 is manipulated so as to cause the opening tool 164 to open a monitoring valve 133*a* in screen S1. The inner string 160 is then manipulated (moved up and/or down) inside the outer string 120 so that the locating tool 168 locates the locating or indicating profile 190*a*. The set down tool 170 is then manipulated to cause it to set down in the set down profile 192*a*. When the set down tool 170 is set down at location 192*a*, the frac port 174 is adjacent to the slurry outlet 140*a*. The pipe 161 of the inner string 160 has a sealing section that comes in contact with the Inverted seals 144*a* and 144*b*, thereby isolating or sealing section 165 between the seals 144*a* and 144*b* that contains the slurry outlet 140*a* and the frac port 174 adjacent to slurry outlet 140*a*, while providing fluid communication between the inner string and the slurry outlet 140*a*. Sealing section 165 from the section 166 allows the lower port 127*a* of the packer setting device 125*b* to be exposed to the pressure in the section 165 while the upper port 127*b* is exposed to pressure in section 166. The packer 124*b* is then set to isolate zone Z1. Once the packer 124*b* has been set, frac sleeve 140*a* is opened, as shown in FIG. 1, to supply slurry or another fluid to zone Z1 to perform a fracturing or a treatment operation. Once zone Z1 has been treated, the treatment fluid in the wellbore is removed by closing the reversing valve 166 to provide a fluid path from the surface in the space (or annulus) between the outer string 120 and the inner string 160 so that a fluid supplied into such annulus at the surface will cause the treatment fluid to move to the surface, which process is referred to as reverse circulation. After reverse circulation, the inner string 160 may then be moved to set down device 170 at another zone for treatment operations. A non-limiting embodiment of a flow device for reverse circulation is described below in reference to FIGS. 3-4.

Figure 2:
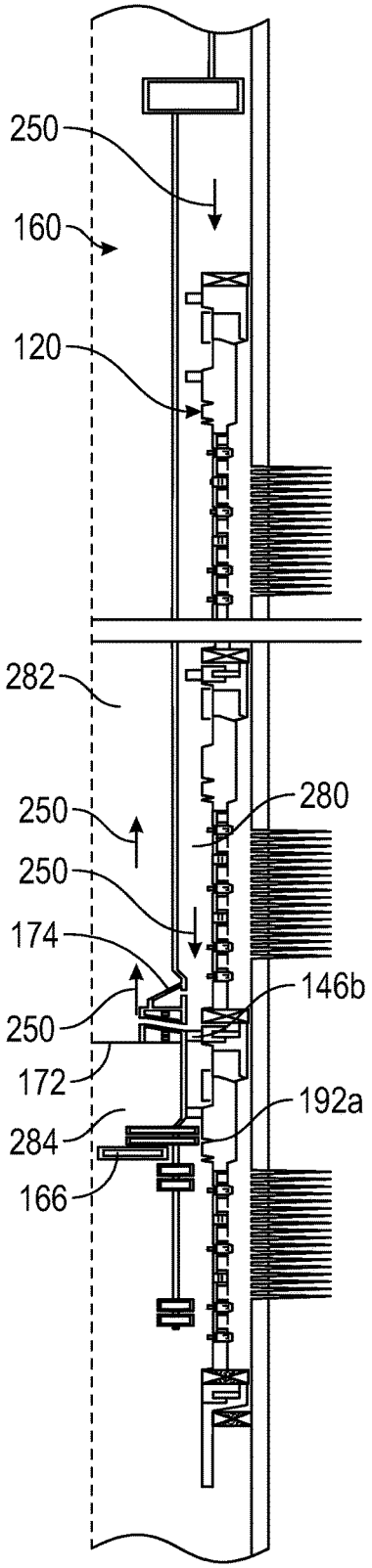
FIG. 2 shows position of the inner string wherein the locating tool is engaged with a locating profile in the outer string so that a wellbore operation may be performed.

FIG. 2 shows the position of the inner string 160 in the outer string 120, wherein the locating tool 168 is engaged with the locating profile 192*a* of the outer string 120 so as to perform a reverse circulation step. In this position, seal 146*a* seals the frac port 174 and creates a fluid passage between annulus 280 and the inner string section 282 above the device 172. The flow device 166 is then closed to prevent flow of the fluid from section 282 to section 284 below the flow device 166. A fluid 250 is then supplied into the annulus 280, which fluid enters the section 282 via the frac port 174 to cause the fluid present in the section 282 to move to the surface as shown by arrows 250.

Figure 3:
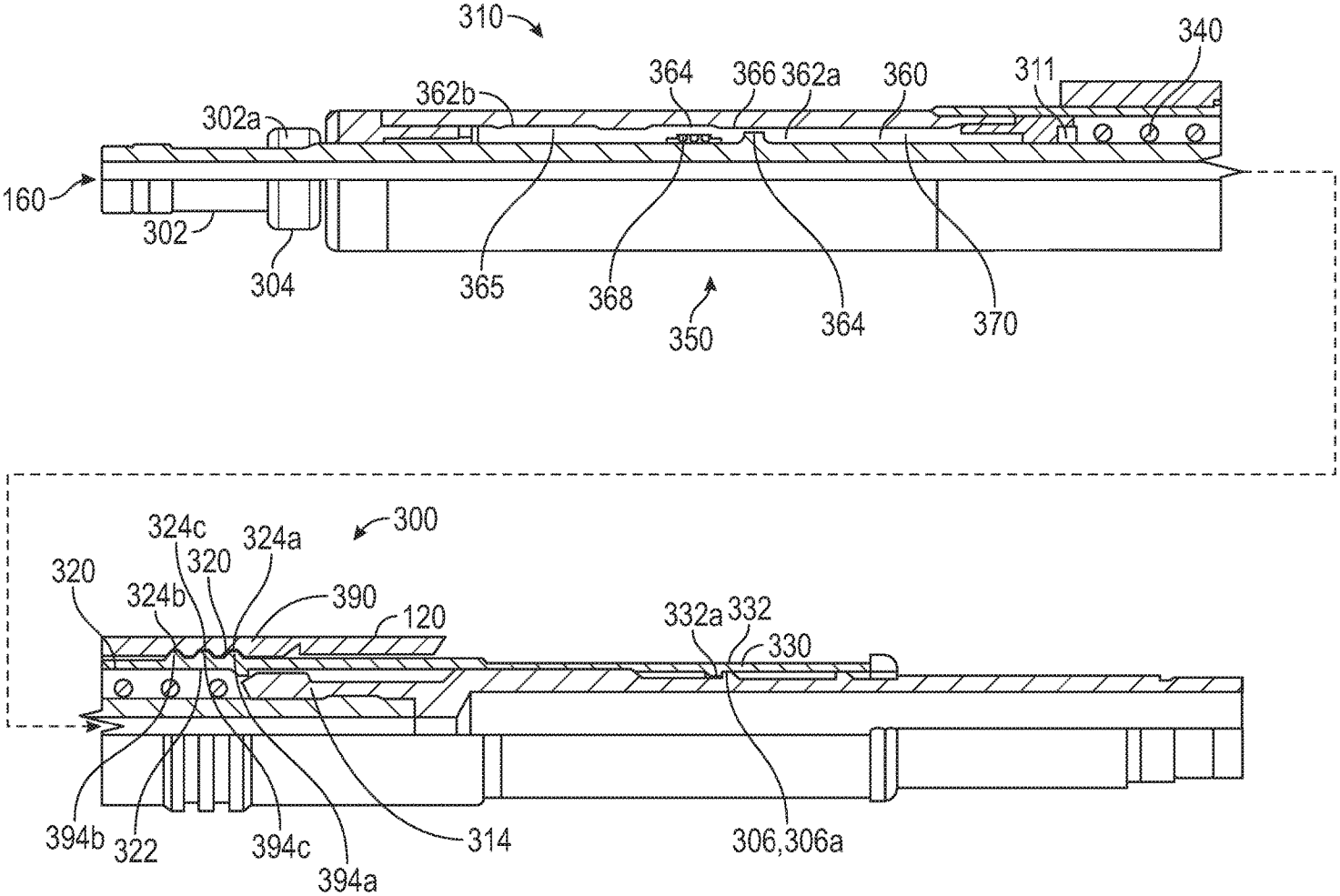
FIG. 3 shows a locating tool, according to a non-limiting embodiment of the present disclosure.

FIG. 3 shows a non-limiting embodiment of a locating tool 300 that, in one non-limiting embodiment, may be utilized as the up-strain tool 168 in the inner string 160 shown in FIG. 2. In one non-limiting embodiment, the location tool 300 may include a mandrel 302 having a mechanical stop 304 at an end 302*a* thereof (also referred to herein as the upper end) and a profile 306 (also referred to herein as the locking profile). The mandrel 302 may be connected to the inner string 160, as shown in FIG. 1. The locating tool 300 also includes an engagement device or locating device 310 that includes a locating collet 320 (also referred to as the first collet), that has an outer profile or locating profile 322 that may further include a lower profile 324*a*, an upper profile 324*b* and an outer protrusion 324*c* therebetween. The outer string 120, which also may act as a housing to the locating collet 320, includes a locating profile 390 that includes a lower profile 394*a*, an upper profile 394*b* and an inner indent 394*c*. The locating profile 322 is configured to engage with the locating profile 390. In one aspect, the locating profile 322 is configured to engage with the locating profile 390 when the locating tool 300 is pulled or moved upward or uphole (to the left in FIG. 3) and not engage when pushed or moved downward or downhole (to the right in FIG. 3). Engaging the locating profile 322 with the locating profile 390 prevents the locating tool 300 and thus the inner string 160 from moving in the outer string 120 in the upward direction. The locating profile 322 of the locating device 310 may be disengaged from the locating profile in the outer string 390 by pulling uphole the inner string 160 in the outer string 120, with a pull force (also referred to as pull load) that exceeds a threshold (which may be a selected or predetermined value) value "F1." In a multi-zone wellbore system, such as wellbore system 100 shown in FIG. 1, each zone (Z1-Zn) may include an associated locating profile, such as profile 390. Locating profiles 322 and 390 may be made unique for a given inner and outer string so that when the inner string is run in the outer string, the locating profile 322 of the inner string 160 will engage only with locating profiles 390 in the outer string. Such a configuration enables an operator at the surface to selectively and positively locate any of the profiles 390 as desired and perform a wellbore operation at such selected location. The locating device 310 further may include a second collet (also referred to as the locking collet) 330 having a locking profile 332. The locking profile 332 includes a shoulder 332*a*. When the mandrel 302 moves uphole inside the locating collet 320, a shoulder 306*a* of locking profile 306 on the mandrel 302 abuts the shoulder 332*a* of the locking collet 330, thereby preventing upward movement of the mandrel 302 inside the locating collet 320. As described below, the locking profile 306 may be disengaged from the locking collet 330 by applying a pull load on the mandrel 302 above a second threshold (a selected or predetermined value) F2, which is less than the threshold value F1.

Still referring to FIG. 3, the locating device 310 includes a biasing member, such as a spring 340 which is supported by the mandrel 302 with a nut 311 on one side and a shoulder or pin 314 on the other side. When mandrel 302 is moved upward, the shoulder 314 compresses the spring 340. The engagement device 310 may also include a delay device (also referred to herein as a delay mechanism or a resistance device) 350 that delays the application of a pull load applied by pulling of the mandrel uphole on the locating collet 320 for a period of time. This time delay provides an indication to an operator at the surface that the engagement device 310 is properly engaged with the locating profile 390. As described below, the delay device 350 prevents application of the pull load on the locating profile 322 until the delay device 350 has switched from a first mode (also referred to as the "un-stroked position") to a second mode (also referred to as the "stroked position"). Pulling the mandrel 302 with a pull load exceeding F2 causes the locking profile 306 of the mandrel to disengage from the locking collet profile 332 and enables the mandrel 302 to move upward. Moving the mandrel 302 upward triggers or initiates a process to switch the delay device 350 from the first mode to the second mode, which process, as described earlier, takes a selected amount of time.

Figure 4:
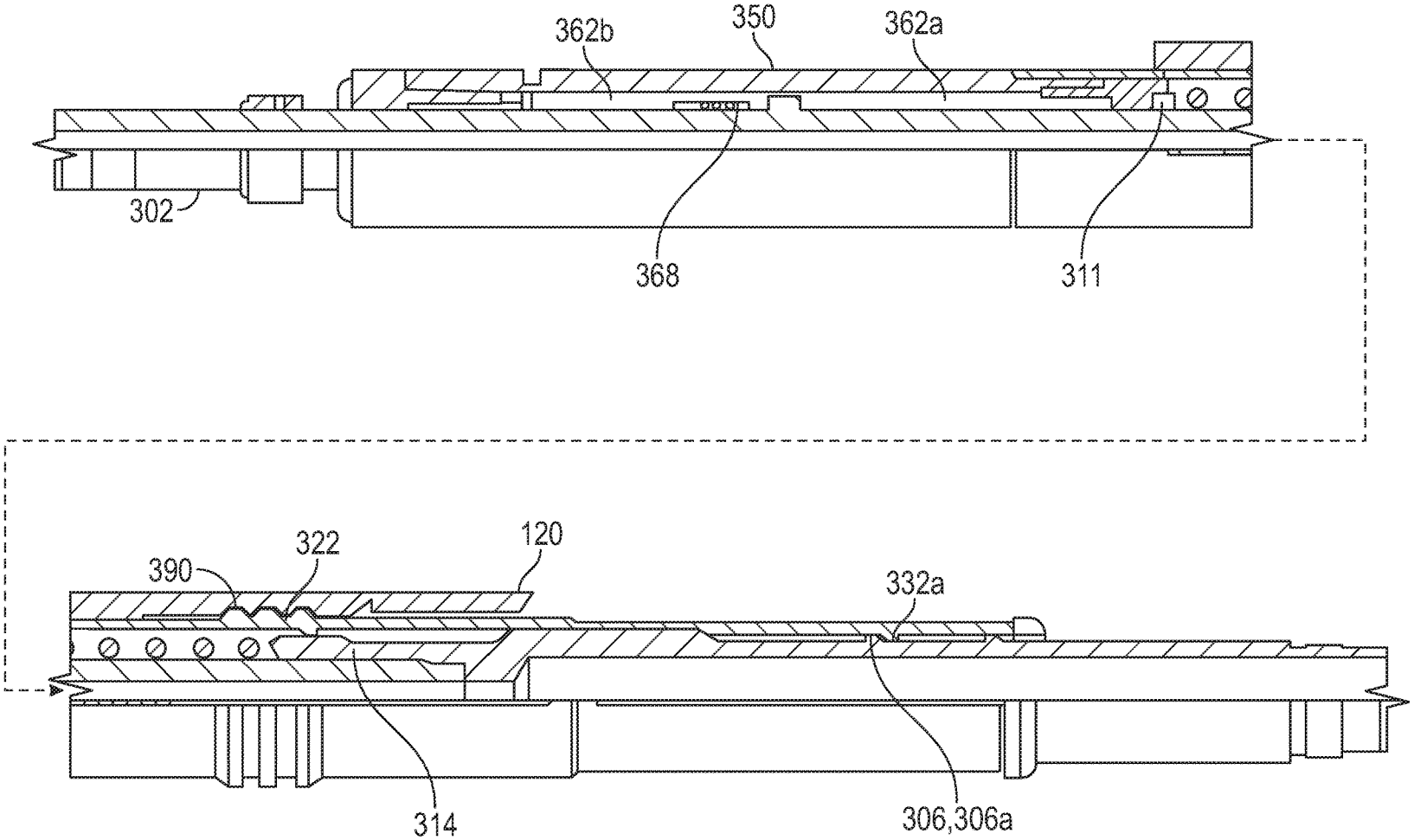
FIG. 4 shows the locating tool shown in FIG. 3 when a delay device in the locating tool has been initiated.
Figure 5:
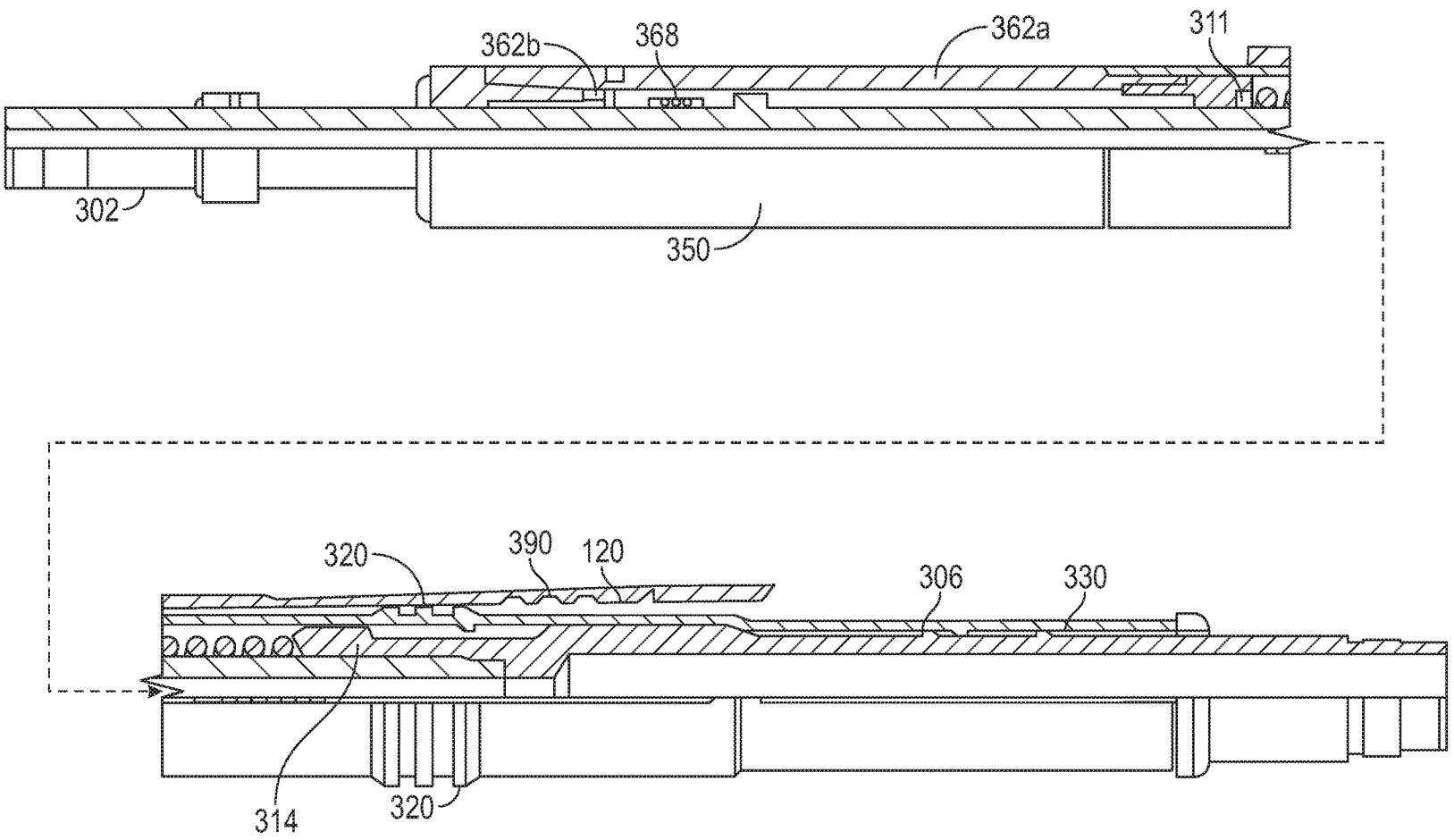
FIG. 5 shows the locating tool of FIG. 4 when the delay device has switched to position that enables the locating tool to disengage from the locating profile in the outer string.

In one non-limiting embodiment, the time delay device 350 may include a hydraulic fluid chamber 360 that includes a piston 364 that divides the chamber 360 into a lower or first chamber 362*a* and an upper or second chamber 362*b*. The chamber 360 is filled with a clean hydraulic fluid 365. A relatively narrow fluid passage 366 (also referred to as a restriction passage) is provided between the first chamber 362*a* and the second chamber 362*b* to meter (controllably discharge) the fluid 365 from the upper chamber 362*b* to lower chamber 362*a*. A compensating device, such as a piston and spring 370, may be provided to compensate for change in volume of the hydraulic fluid 365 due to changes in the temperature and the hydrostatic pressure in the wellbore. When mandrel 302 is pulled uphole with a pull load that exceeds F2, the shoulder 306*a* of the locking profile 306 disengages from the shoulder 332*a* of the locking collet 330, as shown in FIG. 4. At this stage, pin 314 acts on the delay device 360 to move the piston 364 upward, which initiates the transfer of fluid 365 from the upper chamber 362*b* to the lower chamber 362*a*, i.e., the delay process for the delay device 360 to move from the first mode to the second mode. Initiation of the delay process causes the upper chamber 362*b* to attain high pressure relative to the lower chamber 362*a*. The delay process continues to transfer fluid 365 from the upper chamber 362*b* to the lower chamber 362*a* until stop ring 368 moves to an end position, which allows the pressures in the upper chamber 362*b* and the lower chamber 362*a* to equalize, thus moving the delay device to the second mode. Applying a pull load to the mandrel 302 that exceeds (or is greater than) F1 when the delay device 350 is at the second mode shown in FIG. 4 will cause the locating profile 330 on the locating collet 320 to disengage from the locating profile 390 in the outer string 120 and enable the engagement device 310 to move uphole, as shown in FIG. 5.

Figure 6:
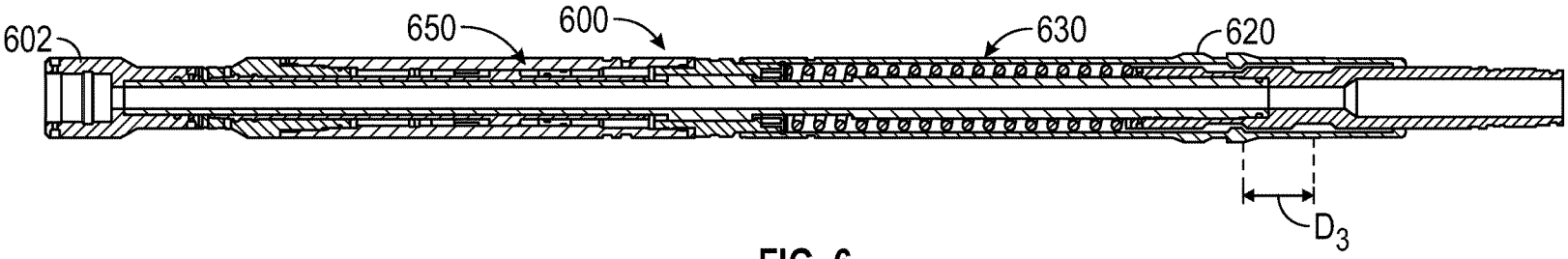
FIG. 6 is another embodiment of the locating tool wherein activation device to activate the delay device includes a preloaded biasing member.
Figure 7:
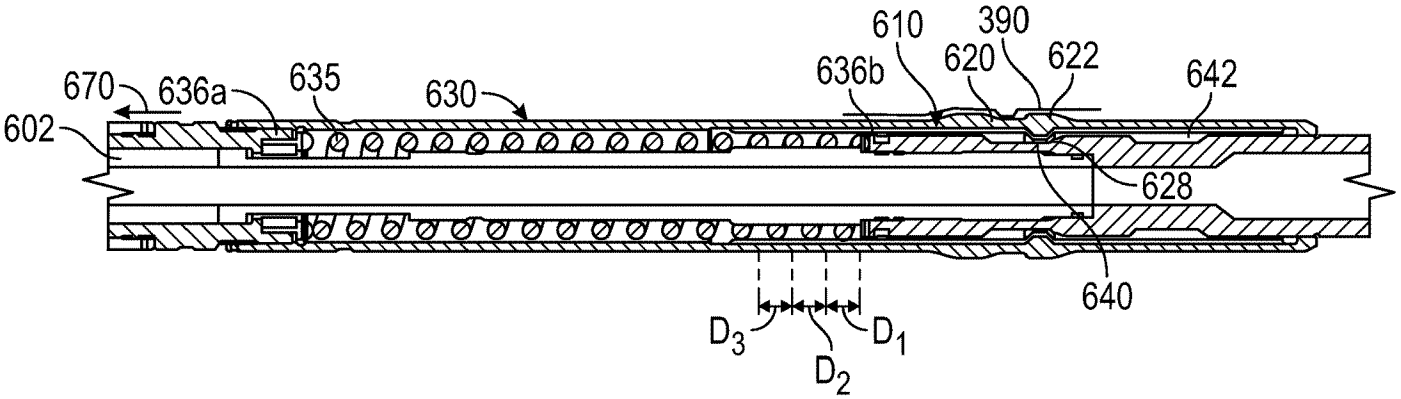
FIG. 7 shows an enlarged view of the activation device and the locating device shown in FIG. 6.

FIG. 6 is another embodiment of a locating tool 600. The locating tool 600 includes a locating section 610, a delay device 650 and an activation device 630 to cause the delay device to shift from an inactive or first mode to an activated or second mode. FIG. 7 shows an enlarged view of the locating section 610 and the activation device 650. Referring now to FIGS. 6 and 7, the delay device 650 in FIG. 6 is the same as the delay device 350 in FIG. 3. The locating section 610 includes a locating collet 620 configured to engage with the locating profile 390 of the outer string 120. The activation device includes a preloaded biasing member, such as spring 635 that is supported at ends 636*a* and 636*b*. The activation device 630 further includes a locking collet 640 configured to engage with grooves 628 and 642 in the mandrel 602. The activation device 630 further includes a locking collet 640 that is configured to engage with grooves 628 and 642 in the mandrel 202. In one aspect, the locating collet 620 does not engage with the locating profile 390 when the locating tool 600 is moved downward or downhole (to the right in FIG. 6). The locating collet 640, however, engages with each profile 390 in the outer string when moving upward or uphole. When the locating collet 620 is engaged with a locating profile 390, it may be disengaged from the locating profile by applying a force F3 to the locating collet 640. In the locating tool 600, a delay device 650 delays the application of any force on the locating collet by a selected time period. The delay device 650 may be initiated an moved from the first mode to the second mode by application of a force F4 less than force F3 in a manner similar to described in reference to FIGS. 4-5.

When the mandrel 602 is pulled with a force F4 or greater, the spring 635 is compressed. When the spring 635 is compressed to a first distance D1, the delay or metering device 650 is initiated and the fluid starts to transfer form one chamber to the other chamber as described in reference to FIG. 4-5. Continued pulling of the mandrel 602 continues to compress the spring 635 to position D2 where the metering device is no longer active. Pulling the inner string 160*n* (FIG. 1) with a force F3 or greater will cause the locating collet 620 to collapse, causing the locating collet 620 to disengage from the locating profile 390 and cause the locking collet 640 to engage with the groove 642. In aspects, the spring 635 in the embodiment of FIG. 6 may have preloaded strength equal to the locking collet 330 plus the spring preload of the embodiment of FIG. 3, i.e., the difference in the two embodiments is effectively the preloaded force of the spring 635. In one aspect, the preloaded spring 635 may have an equivalent preloaded strength equal to the locking collet 330 in the embodiment of FIG. 3 and the preload of spring 340. Thus, the difference between the embodiment of FIGS. 3 and 5 may be the preload force of the spring 635.

The foregoing disclosure is directed to the certain exemplary embodiments and methods of the present disclosure. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. An apparatus for use in a wellbore; comprising:

a locating device having a locating collet configured to engage with a locating profile on a housing and disengage from the locating profile when a first pull load is applied to the locating collet;

a mandrel having a locking profile; and a locking collet of the locating device configured to engage with the locking profile of the mandrel and disengage from the locking profile of the mandrel when a second pull load is applied to the mandrel, wherein the second pull load is less than the first pull load; and a delay device that is activated by disengagement of the locking collet from the locking profile and prevents application of the first pull load on the engaged locating collet until the delay device has been moved from a first position to a second position, the delay device including a hydraulic fluid chamber that includes a piston dividing the chamber filled with a hydraulic fluid.

2. The apparatus of claim 1, wherein the locking collet remains engaged with the locking profile to prevent activation of the delay device until application of the second pull load on the mandrel.

3. The apparatus of claim 2, further comprising a preloaded spring and wherein application of the second pull load on the mandrel causes the preloaded spring to compress and move the mandrel from the first position to the second position.

4. The apparatus of claim 2, wherein the locating collet and the locking collet are carried by a common member with the locating collet having an outer profile that engages with the locating profile on the housing and the locking collet having an inner profile that engages with the locking profile on the mandrel.

5. The apparatus of claim 1, wherein the delay device is activated when the delay device switches from the first position to the second position in a selected time period.

6. The apparatus of claim 5, wherein the delay device includes a first fluid chamber in pressure communication with a second fluid chamber, a piston between the first chamber and the second chamber, applying a load on the piston causes the fluid to move from the first chamber to the second chamber over a selected time period to activate the delay device.

7. The apparatus of claim 6, wherein the delay device further includes a hydraulic compensation device to compensate for change in volume of hydraulic fluid in the first chamber and the second chamber during wellbore operations.

8. The apparatus of claim 1, wherein the housing is part of an outer string deployed in the wellbore and the delay device and the locking collet are carried by an inner string conveyed inside the outer string to perform a well operation.

9. The apparatus of claim 8, wherein the outer string includes a plurality spaced apart locating profiles and wherein the locating collet is configured to pass each such locating profile when the locating collet is moved downward and engage with each such locating profile collet to the exclusion of any other profile in the outer string when the locating collet is moved upward.

10. The apparatus of claim 1 further comprising a biasing member supported by the mandrel, wherein the biasing member compresses when the mandrel is pulled to initiate a process to switch the delay device from the first positon to the second position and cause the locking profile on the mandrel to engage with the second profile after the delay device has switched to the second position.

11. A method of performing an operation in a wellbore; comprising:

conveying an outer string and an inner string into a wellbore, wherein the outer string includes a locating profile and the inner string includes:

a locating device having a locating collet configured to engage with the locating profile and disengage from the locating profile when a first pull load is applied to the locating collet, a mandrel having a locking profile, a locking collet of the locating device configured to engage with the locking profile of the mandrel and disengage from the locking profile of the mandrel when a second pull load is applied to the mandrel, wherein the second pull load is less than the first pull load, and a delay device that is activated by disengagement of the locking collect from the locking profile and prevents application of the first pull load on the engaged locating collet until the delay device has been moved from a first position to a second position, the delay device including a hydraulic fluid chamber that includes a piston dividing the chamber filled with a hydraulic fluid;

pulling the inner string to engage the locating collet with the locating profile; and performing the wellbore operation.

12. The method of claim 11, wherein the wellbore operation includes:

moving the inner string to move the locating collet downhole from the locating profile;

setting the inner string in the outer string at a selected location downhole from the locating profile; and performing the wellbore operation.

13. The method of claim 12, wherein the wellbore operation includes one of: a fracturing and packing operation; a flooding operation; and a gravel packing operation.

14. The method of claim 12 further comprising:

pulling the inner string upward to engage the locating collet with the locating profile;

activating the delay device; and applying the first pull load on the locating collet to disengage the locating collet from the locating profile to pull the inner string upward of the locating profile.

15. The method of claim 14, wherein disengaging the locating collet from the locating profile causes the locking collet to engage with another locking profile on the mandrel that is spaced apart from the locking profile.

16. The method of claim 11 further comprising:

wherein the locking collet remains engaged with the locking profile to prevent activation of the delay device until the application of the second pull load on the mandrel.

17. The method of claim 16 further comprising:

providing a preloaded spring so that applying the second pull load on the mandrel causes the preloaded spring to compress and move the mandrel a certain distance to initiate the activation of the delay device.

18. The method of claim 16 further comprising providing the locating collet and the locking collet on a common member with the locating collet having an outer profile that engages with the locating profile on the housing and the locking collet having an inner profile that engages with the locking profile on the mandrel.

19. The method of claim 11 further comprising:

providing for the delay device a first fluid chamber in pressure communication with a second fluid chamber, a piston between the first chamber and the second chamber; and applying a load on the piston to cause the fluid to move from the first chamber to the second chamber over a selected time period to activate the delay device.

20. The method of claim 19 further comprising providing a hydraulic compensation device to compensate for change in volume of the hydraulic fluid in the first chamber and the second chamber during the wellbore operation.

21. The method of claim 11 further comprising providing a plurality of spaced apart locating profiles in the outer string and configuring the locating collet to bypass each such locating profile when the locating collet is moved downward and engages with each such locating profile when the locating collet is moved upward to the exclusion of any other profile in the outer string.

* * * * *